United States Patent [19]

Hyre

[11] 4,242,077

[45] Dec. 30, 1980

[54] FLUID BED FURNACE AND FUEL SUPPLY SYSTEM FOR USE THEREIN

[75] Inventor: Charles E. Hyre, Chesterton, Ind.

[73] Assignee: Fennell Corporation, Harvey, Ill.

[21] Appl. No.: 958,138

[22] Filed: Nov. 6, 1978

[51] Int. Cl.[3] ..... F23D 19/02; F23Q 3/00

[52] U.S. Cl. ..... 431/19; 431/7; 431/170; 431/264; 432/58; 110/101 CB

[58] Field of Search ..... 431/7, 19, 58, 59, 78, 431/170, 264, 266, 43–46; 432/58; 122/4 D; 110/245, 263, 347, 101 CB

[56] References Cited

U.S. PATENT DOCUMENTS

| | | | |
|---|---|---|---|
| 2,147,881 | 2/1939 | Chambers | 110/101 CB |
| 2,178,171 | 10/1939 | Hellmann et al. | 110/101 CB |
| 2,656,799 | 10/1953 | Hatton | 110/101 CB |
| 3,884,617 | 5/1975 | Virr | 110/190 X |
| 3,903,846 | 9/1975 | Elliott et al. | 122/4 D |
| 3,938,936 | 2/1976 | Vizmeg | 431/43 X |
| 4,017,269 | 4/1977 | Dutz et al. | 110/101 CB X |

FOREIGN PATENT DOCUMENTS

| | | | |
|---|---|---|---|
| 1433482 | 4/1976 | United Kingdom | 122/4 D |

*Primary Examiner*—Robert S. Ward, Jr.
*Attorney, Agent, or Firm*—Trexler, Wolters, Bushnell & Fosse, Ltd.

[57] ABSTRACT

A fuel supply system for use in a fluid bed furnace or the like of the type which includes a bed comprising a quantity of particles, which bed fluidizes in response to the flow of heated gases upwardly therethrough and a burner for burning a supplied fuel and providing the fluid bed with a sufficient gas mixture flow at an elevated temperature for heating and fluidizing the fluid bed. The fluid supply system includes a source of air, a source of gas fuel, mixing means coupled to the furnace burner for mixing the air and gas fuel together for providing the burner with a fuel mixture, flow rate control means for providing the air and gas fuel to the mixing means in substantially stoichiometric flow rate proportions and fluid bed level detecting means for sensing the level of the fluidizable material within the fluid bed and coupled to the flow rate control means for varying the flow rates of the gas fuel and air provided to the mixing means in direct relation to the level of the fluidizable material within the fluid bed. As a result, excessive agitation of the fluid bed is avoided.

12 Claims, 1 Drawing Figure

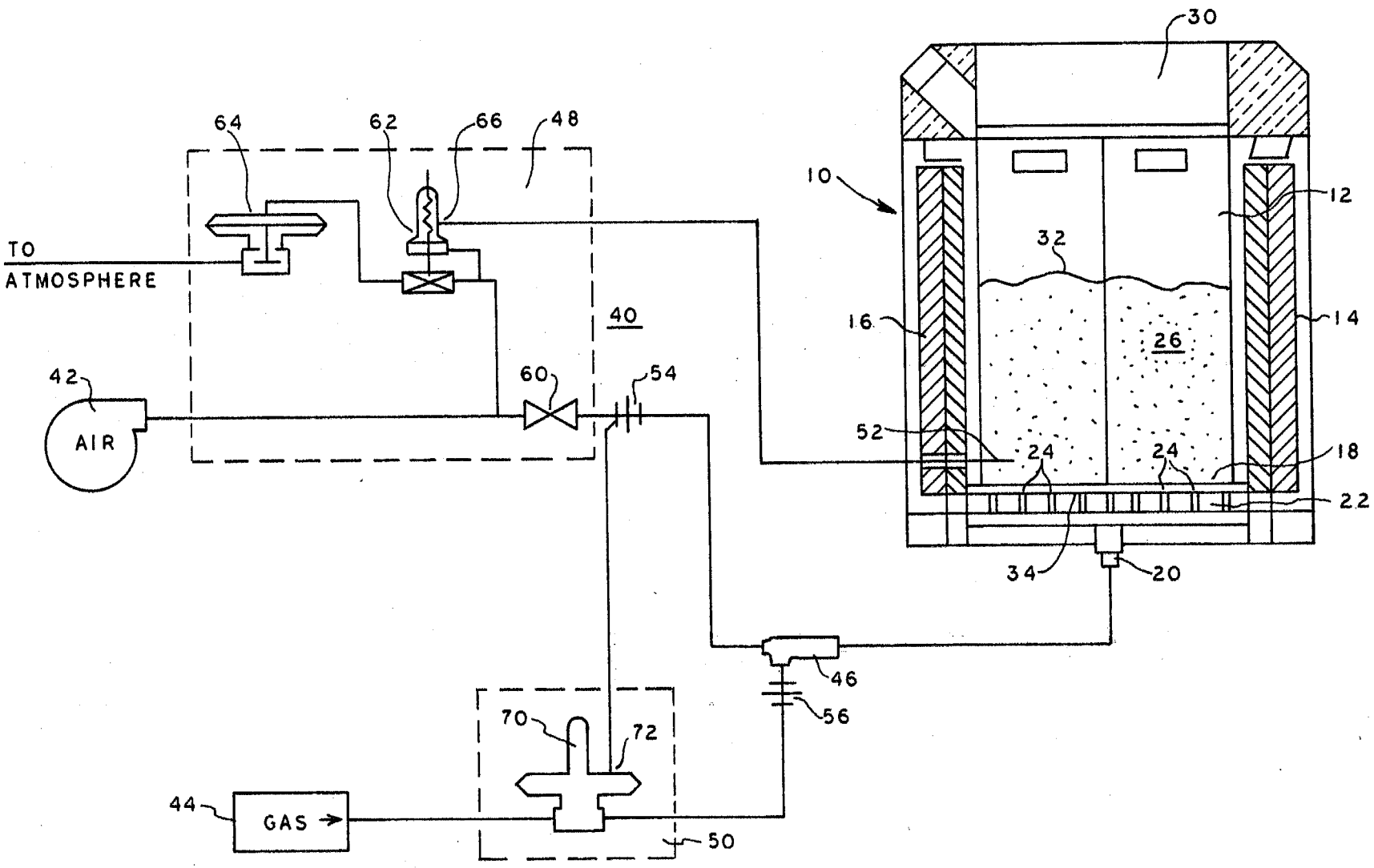
10
12
14
16
18
20
22
24
26
30
32
34
40
42
44
46
48
50
52
54
56
60
62
64
66
70
72
AIR
GAS
TO ATMOSPHERE

FLUID BED FURNACE AND FUEL SUPPLY SYSTEM FOR USE THEREIN

BACKGROUND OF THE INVENTION

The present invention is directed generally to an improved fluid bed furnace and more particularly to a new and improved fuel supply system for use in a fluid bed furnace.

Furnaces for heat-treating metal components or the like are well known. Such furnaces have included a heated bath taking the form of melted salt or molten lead. The salt or molten lead baths are heated to an elevated temperature and the metal components to be treated are immersed therein, whereupon, the heat of the baths is transferred to the metal components for treatment.

Such furnaces, while being generally successful in heat-treating metal components or the like, have exhibited certain difficulties. For example, heated molten salt is hazardous when employed because it is potentially explosive should water come into contact with the heated salt. The salt may be heated to a temperature of, for example, 1400°–2000° F., which, upon contacting water, will explode. Hence, a great deal of care is necessary when employing such a furnace to make sure that water does not come into contact with the salt baths.

In the case of molten lead baths, molten lead is extremely acidic in nature, and hence, it is difficult to use in terms of finding a suitable container in which to confine the molten lead. Furthermore, molten lead and salt are wetting materials which as a result wet the metallic components being heat treated. As a result, some means must be provided for removing the molten lead or salt bath materials from the component subsequent to being treated.

In view of the foregoing, a furnace for heat-treating metal components or the like has been proposed which does not include salt or molten baths. In contrast, this type of furnace utilizes fluidizable material which may take the form of corrundum or silica particles. One material which becomes fluidized upon being subjected to a sufficient flow of heated gas and which has become popular for such use is sand.

Such furnaces, have become known as fluid bed furnaces, and one such furnace is fully described in U.S. Pat. No. 3,884,617, which patent is incorporated by reference herein. The particulate fluidizable material is confined within a container known as a fluid bed. Below the fluid bed is a burner which burns a fuel mixture usually comprising a mixture of natural gas and air in substantially stoichiometric proportions. Upon burning the fuel mixture, the burner provides a heated gas mixture which is at an elevated temperature and which flows upwardly and heats and fluidizes the fluid bed. The heat from the gas mixture is transferred to the fluidizable material within the fluid bed so that metal components placed within the fluid bed in turn receive heat from the fluid bed for heat treating.

Furnaces of this type have become increasingly popular because they provide relative high heat-transfer efficiency and do not exhibit the shortcomings previously alluded with respect to the salt and molten lead bath type furnaces. More particularly, fluidizable materials such as sand are inert and therefore will not corrode or eat away at the walls of the fluid bed containing the fluidizable material. Also, upon being heated, the fluidizable material such as sand is not explosive and therefore its contact with water need not be a source of concern. Should water come into contact with the heated fluid bed, the water will merely be converted to steam without a dangerous condition being present. Lastly, the sand fluidizable material is non-wetting. As a result, metal components treated therein need not be processed subsequent to the heat treating for the purpose of removing the fluidizable material.

As usually encountered in the use of such a furnace, the heat-treated components will remove a small portion of the fluidizable material. After prolonged use, such as a matter of days, a sufficient number of components will be treated such that the level of the fluid bed will be decreased by a significant amount. Should the burner continue to heat the fluidizable material at the same BTU rate, excessive agitation of the fluidizable material particles will result. Such excessive agitation can cause the fluidizable material to actually escape from the top of the fluid bed.

It is therefore a general object of the present invention to provide a new and improved fluid bed furnace which precludes excessive agitation of the fluidizable material even when the level of the fluidizable material within the fluid bed decreases.

It is a more specific object of the present invention to provide a new and improved fuel supply system for a fluid bed furnace which senses the level of the fluidizable material within the fluid bed and in response to such sensing, varies the rate in which the fuel mixture is supplied to the furnace burner in direct relation to the level of the fluidizable material within the fluid bed to prevent excessive agitation of the fluidizable material.

SUMMARY OF THE INVENTION

The invention provides a fuel supply system for use in a fluid bed furnace or the like of the type including a fluid bed containing a quantity of material which fluidizes upon being subjected to a sufficient flow of gases heated to an elevated temperature and a burner for burning a supplied fuel and providing the fluid bed with a gas mixture at an elevated temperature for heating and fluidizing the fluid bed. The fuel supply system comprises a source of air, a source of gas fuel, and mixing means coupled to the furnace burner for mixing the air and gas fuel together for providing the burner with a fuel mixture. The fuel supply system further includes a flow rate control means for providing the air and gas fuel to the mixing means in substantially stoichiometric flow proportions and fluid bed level detecting means for sensing the level of the fluidizable material within the fluid bed and coupled to the flow rate control means for varying the flow rates of the gas fuel and air provided to the mixing means in direct relation to the level of the fluidizable material within the fluid bed.

The invention further provides a fluid bed furnace comprising a fluid bed containing material which fluidizes upon being subjected to a flow of heated gases, a burner for burning a supplied fuel mixture and providing the fluid bed with a heated gas mixture flow for fluidizing the fluidizable material, an air source, a gas fuel source, means coupled to the air source, to the gas fuel source, and to the burner for combining the air and gas fuel in substantially stoichiometric proportions and delivering the resultant fuel mixture to the burner, and means responsive to the amount of fluidizable material within the fluid bed for varying the flow rate of the fuel mixture delivered to the burner in direct relation to the amount of the fluidizable material within the fluid bed.

BRIEF DESCRIPTION OF THE DRAWINGS

The single FIGURE of drawing is a schematic illustration of a fuel supply system according to the present invention shown in operative relationship with a fluidized bed furnace.

DESCRIPTION OF THE PREFERRED EMBODIMENT

Referring now to the sole FIGURE, the fluid bed furnace 10 thereshown generally includes a fluid bed 12 which is formed by a container comprising insulated side walls 14 and 16 and a bottom metal grid 18. Beneath the fluid bed 12 is a burner assembly which includes an input port 20 which receives a fuel mixture to be burned and a ceramic tile plate 22. The ceramic tile plate 22 includes a plurality of apertures 24 through which the fuel mixture enters the fluid bed and above which the fuel mixture is flamed.

Within the fluid bed 12 is contained a quantity of fluidizable material 26 which may be, for example, sand particles. The burner assembly, upon burning the fuel mixture, provides a heated gas mixture to the fluidizable material 26 to heat and fluidize the fluidizable material 26 contained within the fluid bed 12. Preferably, the fuel mixture burned by the burner comprises natural gas and air mixed together in substantially stoichiometric proportions.

The metal components to be heat treated are received within the fluid bed 12 through an opening 30 at the top of the fluid bed furnace 10. The metal components are immersed in the fluidizable material 26 and are precluded from contacting the ceramic tile plate 22 by the metal grid 18. The fluidizable material 26 is usually heated to an elevated temperature in the range of, for example, 1400° to 2200° F. Such heating and the upward flow of burning and/or burned gases causes agitation of the fluidizable material particles to thus cause the fluidizable materials to flow within the fluid bed 12 and to be continuously circulated therein. The bed of fluidizable particles provides a resistance to the flow of the gas mixture flowing therethrough so that a pressure drop is established between the top level 32 of the fluidizable material and the bottom 34 of the fluid bed. When the level or amount of fluidizable material 26 decreases, the pressure drop or back pressure decreases and should the burner provide heated gas at a constant flow rate, excessive agitation of the fluidizable material particles may occur. In order to preclude such excessive agitation of the fluidizable material, the furnace 10 includes the fuel supply system 40 embodying the present invention for modulating the gas mixture flow rate.

The fuel supply system 40 includes a source of air which takes the form of a blower 42, a source of natural gas fuel 44, mixing means 46 which mixes or combines the air and natural gas fuel together, a flow rate control means comprising a first regulating means 48 and a second regulating means 50, and a fluid bed level detecting means 52.

The air source 42 provides a flow of air to the mixing means 46, which takes the form of a mixing tee, by the first regulating means 48 and an orifice 54. The gas fuel source 44 provides a flow of gas fuel to the mixing tee 46 through the second regulating means 50 and a second orifice 56. The natural gas fuel and air are combined by the mixing tee to form a fuel mixture which is delivered from the mixing tee 46 to the burner port 20.

The first regulating means 48 comprises a modulator valve 60, a pilot regulator 62, and a relief valve 64. The modulator valve 60 is connected between the air source 42 and the orifice 54 and sets a maximum air flow rate to the orifice 54 and the mixing tee 46. The pilot regulator 62 and relief valve 64 are arranged in series and connected between the air source 42 and modulator valve 60. The pilot regulator and relief valve combine to control or vary the air flow rate provided by the air source 42.

The second regulating means 50 includes a gas flow regulator 70 which has a control port 72 coupled to the orifice 54. The control input 72 by being coupled to the orifice 54 senses the back pressure at the orifice 54 and thereby senses the flow rate of the air transferred to the mixing tee 46. Responsive to the sensing of the air flow rate, the gas regulator 70 controls the flow rate of the natural gas fuel so that the flow rates of the air and natural gas received by the mixing tee are in substantially stoichiometric proportions.

The fluid bed level sensing means 52 is located proximate to the bottom 34 of the fluid bed and senses the level of the fluidizable material 26 within the fluid bed 12 by detecting the back pressure of the gas mixture which heats the fluidizable material. The fluid bed detecting means 52 may take the form of a pipe extension which extends into the fluid bed and which is packed with ceramic fiber to prevent the fluidizable material particles from entering therein. The detecting means 52 is coupled to a set input 66 of the pilot regulator to modulate the set point of the pilot regulator as the back pressure within the fluid bed varies with changing fluidizable material levels therein.

In operation, should the level of fluidizable material within the fluid bed 12 increase, an increased back pressure will be sensed by detecting means 52. This in turn will increase the set point of the pilot regulator 62 at its set input 66. This in turn will cause the pilot regulator 62 and relief valve 64 to allow an increased air flow rate from the air source 42 through the modulator valve 60, through orifice 54, and to the mixing tee 46. Because of the increased air flow rate through the orifice 54, this condition will be sensed by the gas regulator input 72 to cause the gas regulator 70 to increase the flow rate of the natural gas fuel through orifice 56 to the mixing tee 46 to maintain the stoichiometric proportion mixing of the air and gas fuel within the mixing tee. Also, as a result, the fuel mixture flow rate from the mixing tee will increase to provide increased BTU heating by the burner 12 and fluidizing of the material 26 within the fluid bed 12.

When the level of the fluidizable material 26 decreases in the fluid bed 12, as usually will be the case after days of use, the detecting means 52 will sense a decreased back pressure within the fluid bed. This will in turn lower the set point of the pilot regulator 62 at its input 66. As a result, the first regulating means 48 will decrease the air flow rate from the air source 42 through the orifice 54 and to the mixing tee 46. Responsive to the decreased air flow rate, the second regulating means 50 will in turn decrease the gas fuel flow rate from the gas source 44 to the mixing tee 46 in order to maintain the stoichiometric mixing proportions. As a final result, the flow rate of the fuel mixture provided by the mixing tee 46 to the furnace burner will decrease to thereby preclude excessive agitation of the fluidizable material 26 within the fluid bed 12.

From the foregoing, it can be appreciated that the present invention provides a new and improved fluid bed furnace and a new and improved fuel supply system for use therein. Because the flow rate of the fuel mixture is varied by the fuel supply system of the present invention in direct relation with the level of the fluidizable material within the fluid bed, excessive agitation of the fluid bed particles is thus avoided. Furthermore, the fuel supply system of the present invention not only precludes excessive agitation of the fluidizable material 26, but in addition, maintains the stoichiometric or any other desired mixing proportions of the air and gas fuel while doing so.

While a particular embodiment of the present invention has been shown and described, modifications may be made, and it is therefore intended to cover in the appended claims all such changes and modifications which fall within the true spirit and scope of the invention.

The invention is claimed as follows:

1. A fuel supply system for use in a fluid bed furnace or the like of the type including a fluid bed containing a quantity of inert, particulate material which fluidizes in response to sufficient gas flow therethrough and a burner for burning a supplied fuel and providing the fluid bed with a gas mixture flow at an elevated temperature for heating and fluidizing the fluid bed, said fuel supply system comprising: a source of air; a source of gas fuel; mixing means coupled to the furnace burner for mixing the air and gas fuel together for providing the burner with a fuel mixture; flow rate control means for providing said air and gas fuel to said mixing means in desired proportions; and fluid bed level detecting means for sensing the level of the inert fluidizable material within the fluid bed and coupled to said flow rate control means for varying the flow rates of the gas fuel and air provided to said mixing means in relation to the level of the fluidizable material within the fluid bed.

2. A fuel supply system as defined in claim 1 wherein said flow rate control means comprises first regulating means for controlling the flow rate of the air provided by said air source, second regulating means for controlling the flow rate of the gas fuel supplied by said gas fuel source, wherein said fluid bed level detecting means is coupled to said first regulating means for causing said first regulating means to vary the air flow rate in direct relation to the level of the fluidizable material within the fluid bed and wherein said second regulating means is responsive to the flow rate of the air for providing the gas fuel at flow rates in direct relation to the air flow rate.

3. A fuel supply system as defined in claim 2 wherein said fluid bed level detecting means is positioned within the fluid bed proximate to the bottom thereof and includes means for sensing the back pressure of said gas mixture.

4. A fuel supply system as defined in claim 2 wherein said first regulating means comprises a modulator valve connected to said air source for setting a maximum air flow rate, a pilot regulator, and a relief valve, said pilot regulator and said relief valve being in series connection and connected across said connection between said air source and said modulator valve, and said pilot regulator also being coupled to said fluid bed level detecting means for varying the air flow rate responsive to said fluid bed level detecting means.

5. A fuel supply system as defined in claim 4 further comprising an orifice coupling said modulator valve to said mixing means and wherein said second regulating means is coupled to said orifice for sensing the air flow rate through said orifice.

6. A fluid bed furnace comprising: a fluid bed containing a quantity of inert, particulate material which fluidizes in response to gas flow therethrough; a burner for burning a supplied fuel mixture and providing said fluid bed with a gas mixture at an elevated temperature for heating and fluidizing said fluidizable material; a source of air; a source of gas fuel; combining means coupled to said burner for mixing the air and gas fuel together for providing said burner with a supplied fuel mixture; flow rate control means for providing said air and said gas fuel to said combining means in desired proportions; and fluid bed level detecting means for sensing the level of the inert fluidizable material within said fluid bed and coupled to said flow rate control means for varying the flow rates of said air and said gas fuel provided to said mixing means in direct relation to the level of the fluidizable material within said fluid bed.

7. A fluid bed furnace as defined in claim 6 wherein said inert fluidizable material is sand.

8. A fluid bed furnace as defined in claim 6 wherein said flow rate control means comprises first regulating means for controlling the flow rate of said air provided by said air source, second regulating means for controlling the flow rate of said gas fuel provided by said gas fuel source, wherein said fluid bed level detecting means is coupled to said first regulating means for causing said first regulating means to vary said air flow rate in direct relation to the level of said fluidizable material within said fluid bed, and wherein said second regulating means is responsive to the flow rate of said air for providing said gas fuel at flow rates in direct relation to the air flow rate.

9. A fluid bed furnace as defined in claim 8 wherein said fluid bed level detecting means is positioned within said fluid bed proximate to the bottom thereof and includes means for sensing the back pressure of said gas mixture.

10. A fluid bed furnace as defined in claim 8 wherein said first regulating means comprises a modulator valve connected to said air source for setting a maximum air flow rate, a pilot regulator, and a relief valve, said pilot regulator and said relief valve being arranged in series and connected between said air source and said modulator valve, and said pilot regulator also being coupled to said fluid bed level detecting means for varying said air flow rate responsive to said fluid bed level detecting means.

11. A fluid bed furnace as defined in claim 10 further comprising an orifice coupling said modulator valve to said combining means and wherein said second regulating means is coupled to said orifice for sensing said air flow rate through said orifice.

12. A fluid bed furnace comprising: a fluid bed containing inert, particulate material which fluidizes in response to gas flow therethrough; a burner for burning a supplied fuel mixture and providing said fluid bed with a heated gas mixture for fluidizing said fluidizable material; an air source; a gas fuel source; means coupled to said air source, to said gas fuel source, and to said burner for combining the air and gas fuel in desired proportions and delivering the resulting fuel mixture to said burner; and means responsive to the amount of inert fluidizable material within said fluid bed for varying the flow rate of said fuel mixture delivered to said burner in direct relation to the amount of said fluidizable material within said fluid bed.

* * * * *